US009241553B1

(12) United States Patent
Winston

(10) Patent No.: US 9,241,553 B1
(45) Date of Patent: Jan. 26, 2016

(54) STORAGE SYSTEMS AND METHODS FOR PERSONAL ITEMS

(71) Applicant: Jeffrey M. Winston, Anacortes, WA (US)

(72) Inventor: Jeffrey M. Winston, Anacortes, WA (US)

( * ) Notice: Subject to any disclaimer, the term of this patent is extended or adjusted under 35 U.S.C. 154(b) by 0 days.

(21) Appl. No.: 13/969,070

(22) Filed: Aug. 16, 2013

Related U.S. Application Data

(60) Provisional application No. 61/684,456, filed on Aug. 17, 2012.

(51) Int. Cl.
*A45C 11/00* (2006.01)

(52) U.S. Cl.
CPC ..... *A45C 11/008* (2013.01); *A45C 2011/007* (2013.01)

(58) Field of Classification Search
CPC ..... A45C 11/00; A45C 11/00824; A45C 2011/007
USPC ..... 206/223, 569, 570, 574, 581, 229, 38, 206/362, 804, 249, 255; 221/208, 247; 132/308, 310, 321
See application file for complete search history.

(56) References Cited

U.S. PATENT DOCUMENTS

| | | | | |
|---|---|---|---|---|
| 1,408,464 | A * | 3/1922 | Moeller | 221/232 |
| 1,897,702 | A * | 2/1933 | Lewnes | 206/255 |
| 5,205,402 | A * | 4/1993 | Maeda | 206/250 |
| 7,721,881 | B2 * | 5/2010 | He | 206/249 |
| 7,793,796 | B1 * | 9/2010 | Evans | 221/113 |
| 2003/0234195 | A1 * | 12/2003 | Earl et al. | 206/338 |

* cited by examiner

*Primary Examiner* — Steven A. Reynolds
*Assistant Examiner* — Javier A Pagan
(74) *Attorney, Agent, or Firm* — Michael R. Schacht; Schacht Law Office, Inc.

(57) ABSTRACT

A container system for an item, where the item comprises a shaft and at least one working end. The container system comprises a container, a cartridge, a slide, and a shaft projection extending from the shaft. The container defines a container chamber and a guide slot. The cartridge defines a plurality of item chambers, and an access slot is associated with each item chamber. The slide adapted extends through the guide slot. The shaft projection extends through the access opening and engages the slide such that movement of the slide causes movement of the item.

19 Claims, 7 Drawing Sheets

STORAGE SYSTEMS AND METHODS FOR PERSONAL ITEMS

RELATED APPLICATIONS

This application, U.S. patent application Ser. No. 13/969,070 filed Aug. 16, 2013, claims benefit of U.S. Provisional Patent Application Ser. No. 61/684,456 filed Aug. 17, 2012, the contents of which are incorporated herein by reference.

TECHNICAL FIELD

The present invention relates to the systems and methods for storing personal items and, more particularly, to the storage systems and methods that allow personal items to be stored and used in a sanitary fashion.

BACKGROUND

Personal items such as cotton swabs, toothbrushes, make-up applicators, medical devices, and the like are desirably kept in a sanitary location when not in use. When personal items are stored and used in a fixed location such as a bathroom, the user has relative control over the conditions under which the personal items are stored. However, when such personal items are carried for use in uncontrolled environments, the user loses control over the conditions under which the personal items are stored.

The need thus exists for storage systems and methods for personal items that allow the user more control over the conditions under which the personal items are stored even when these items are transported and used in uncontrolled environments. In addition, there is need to format, retract, select, and/or hygienically store personal items in a more convenient dispenser/storage system, regardless of controlled environment needs, for transport and location purposes.

SUMMARY

The present invention may be embodied as a container system for an item, where the item comprises a shaft and at least one working end. The container system comprises a container, a cartridge, a slide, and a shaft projection extending from the shaft. The container defines a container chamber and a guide slot. The cartridge defines a plurality of item chambers, and an access slot is associated with each item chamber. The slide adapted extends through the guide slot. The shaft projection extends through the access opening and engages the slide such that movement of the slide causes movement of the item.

The present invention may also be embodied as a container system for an item comprising a shaft and first and second working ends. In this case, the container system comprises a container, a cartridge, a slide, and a shaft projection. The container defines a container chamber and a guide slot. The cartridge defines a plurality of item chambers and an access slot associated with each item chamber. The slide is adapted to extend through the guide slot. The shaft projection extends from the shaft of the item and through the access opening and engages the slide such that movement of the slide causes movement of the item.

The present invention may also be embodied as a method of containing an item comprising a shaft and at least one working end comprising the following steps. A container defining a container chamber is provided, and a guide slot is formed in the container. A cartridge defining a plurality of item chambers is provided. An access slot is formed in the cartridge for each item chamber. A slide is provided and arranged within the container chamber such that a portion of the slide extends through the guide slot. A shaft projection is formed on the shaft of the item. A cartridge assembly is formed by arranging the item within at least one item chamber such that the shaft projection extends through the access slot. The cartridge assembly is arranged within the container chamber such that the shaft projection engages the slide. The slide relative is displaced relative to the container to displace at least a portion of the item from the item chamber. Retraction of items controls hygienic storage and allows selection of additional items.

DETAILED DESCRIPTION

Figure 1:
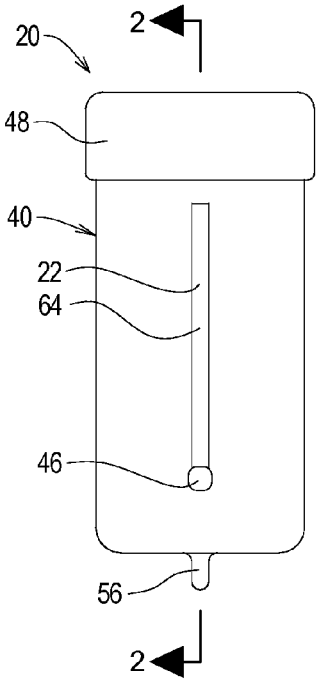
FIG. 1 is a side elevation view of a first embodiment of a storage system of the present invention.

Referring initially to FIGS. 1-3 and 12 of the drawing, depicted at 20 therein is a first example storage system constructed in accordance with, and embodying, the principles of the present invention. The example storage system 20 is adapted to store a cartridge assembly 22 containing one or more personal items, or simply items, 24. The nature of the items 24 is not per se part of the present invention, and the items 24 may take many different specific forms and still be stored effectively by the first example storage system 20.

The example item 24 comprises a shaft 26 and a tip 28. The tip 28 is typically the working or carrying portion of the item 24. The shaft 26 is typically provided primarily for the purpose of manipulating the tip 28 but may be provided with additional functions such as fluid storage or the like. The tip 28 may be, as examples, a cotton tip, a makeup applicator, toothbrush bristles, a sampling swab, a needle, and/or a biometric sensor. The tip 28 thus may be a passive mechanical structure (e.g., cotton tip, makeup applicator, toothbrush bristles, sampling swab), or may be a mechanical system (e.g., needle) or an electromechanical system capable of performing an active function (e.g., biometric sensor). In any event, the example item or items 24 are not per se part of the present invention.

The example item 24 is modified to work as part of the first example storage system 20. In particular, a first shaft projection 30 and first and second guide rings 32 and 34 extend from the shaft 26 of the item 24. The purpose of the shaft projection 30 and the guide rings 32 and 34 will be apparent from the following discussion.

As perhaps best shown in FIGS. 2, 3, 9, 10, and 12, the example storage system 20 comprises a container 40 defining a container axis A, a cartridge 42, an item cover 44, a slide 46, and a cap 48. The item cover 44 is optional depending on the nature of the item 24 and will be discussed in further detail below. In addition, the cartridge 42 may be replaceable as will be further described below. In this case, prior to use a second size and shape of item cover (not shown) may be used to cover the entire cartridge 42, with any included items 24, such as during shipping, retail display, and storage.

Figure 2:
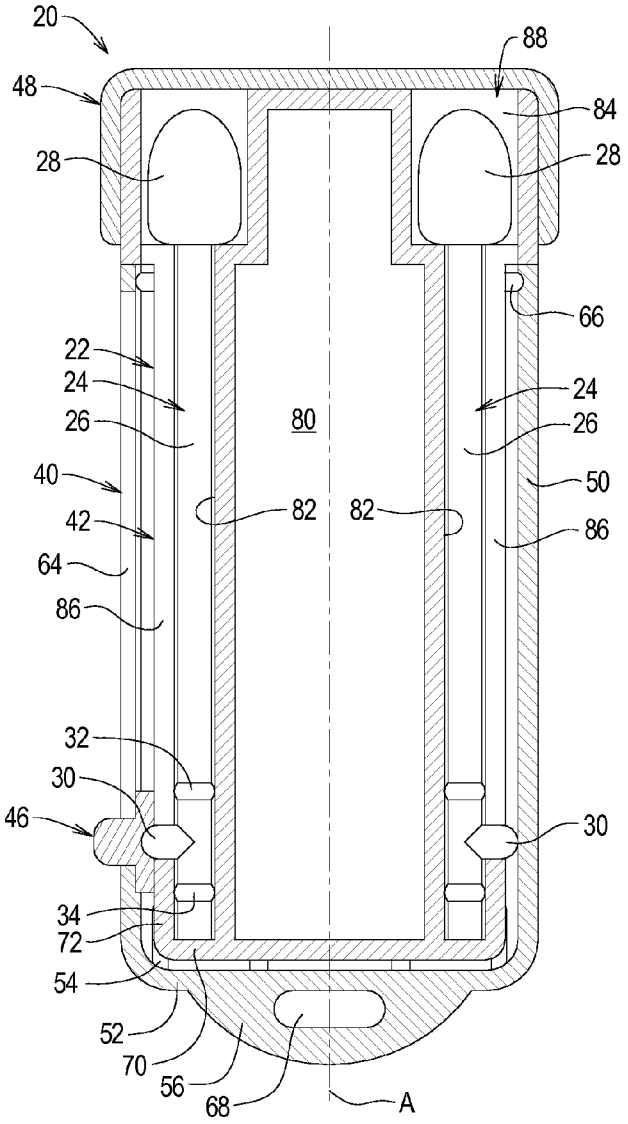
FIG. 2 is a section view taken along lines 2-2 in FIG. 1.
Figure 9:
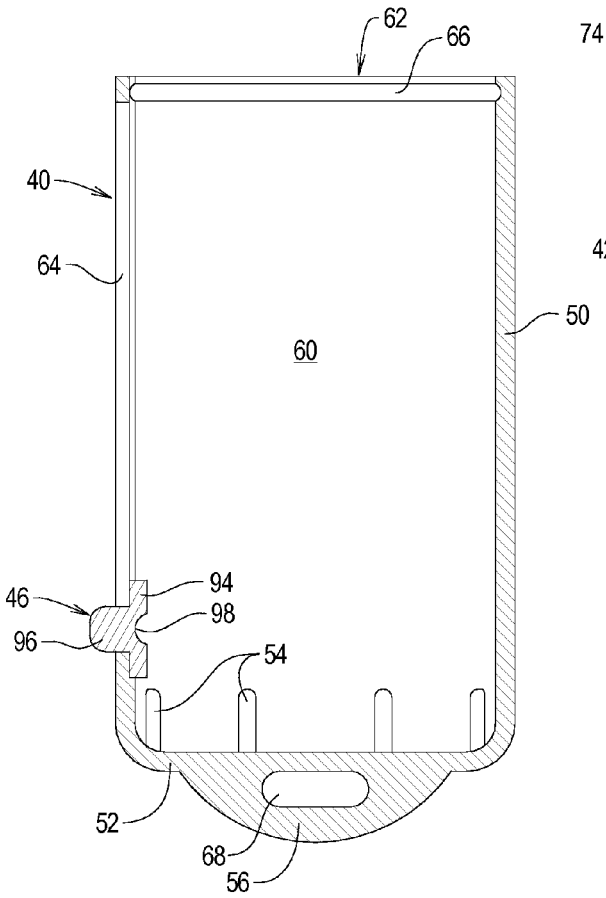
FIG. 9 is a section view depicting details of the container and a slide forming part of the first example storage system.

Referring now to FIGS. 2 and 9 of the drawing, it can be seen that the example container 40 defines a side wall 50, an end wall 52, one or more locating ribs 54, and a tab 56. The example container 40 further defines a container chamber 60, primary access to the container chamber 60 being through a container opening 62. The locating ribs 54 extend from the side wall 50 adjacent to the end wall 52 and into the container chamber 60. The example tab 56 extends from an outer surface of the end wall 52. The example container 40 defines a guide slot 64 extending through the side wall 50 and extending from adjacent to the end wall 52 to adjacent to the container opening 62. The example container 40 further comprises an alignment groove 66 formed in the side wall 50 within the container chamber 60 adjacent to the container opening 62.

Figure 10:
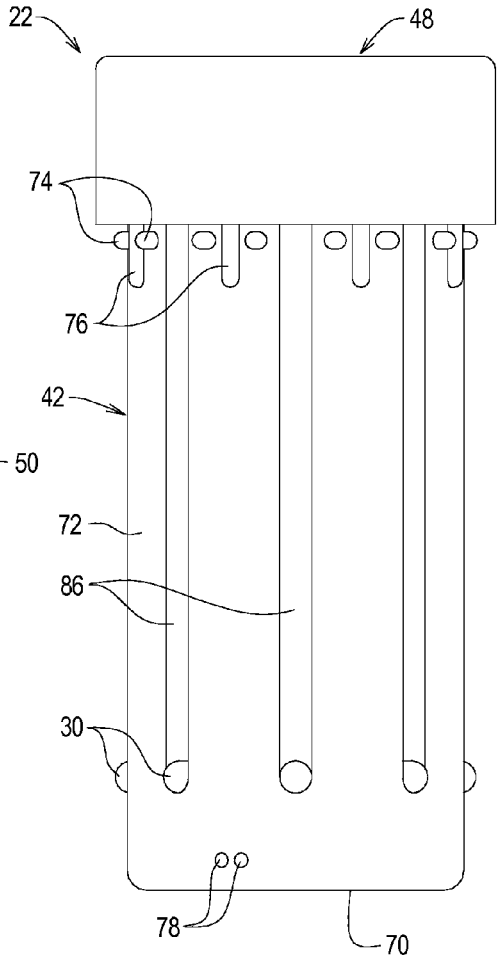
FIG. 10 is a section view depicting details of the cartridge member of the first example storage system.

FIGS. 2 and 10 of the drawing illustrate that the example cartridge 42 defines an end wall 70, a side wall 72, one or more alignment projections 74, one or more locating ribs 76, and a pair of stop projections 78. The example cartridge 42 further defines a cartridge chamber 80, one or more shaft chambers 82, one or more tip chambers 84, one or more access slots 86, and a cartridge opening 88. The shaft chambers 82 and tip chambers 84 together form an item chamber. Each of the access slots 86 is formed in or extends through the side wall 72 from adjacent the end wall 70 to the cartridge opening 88. The tip chambers 84 communicate with the cartridge opening 88 at an end of the cartridge 42 opposite the end wall 70. Each of the tip chambers 84 further communicates with one of the shaft chambers 82. The example alignment projection(s) 74 and locating rib(s) 76 extend from the outer surface of the side wall 72 near the cartridge opening 88. The example stop projections 78 extend from the outer surface of the side wall 72 near the end wall 70. The example cartridge chamber 80 is depicted as being empty in the example cartridge 42 but may be filled with fluids, electronics, energy storage devices (batteries), or the like depending on the details and/or intended use of a particular item 24 and cartridge 42.

Figure 3:
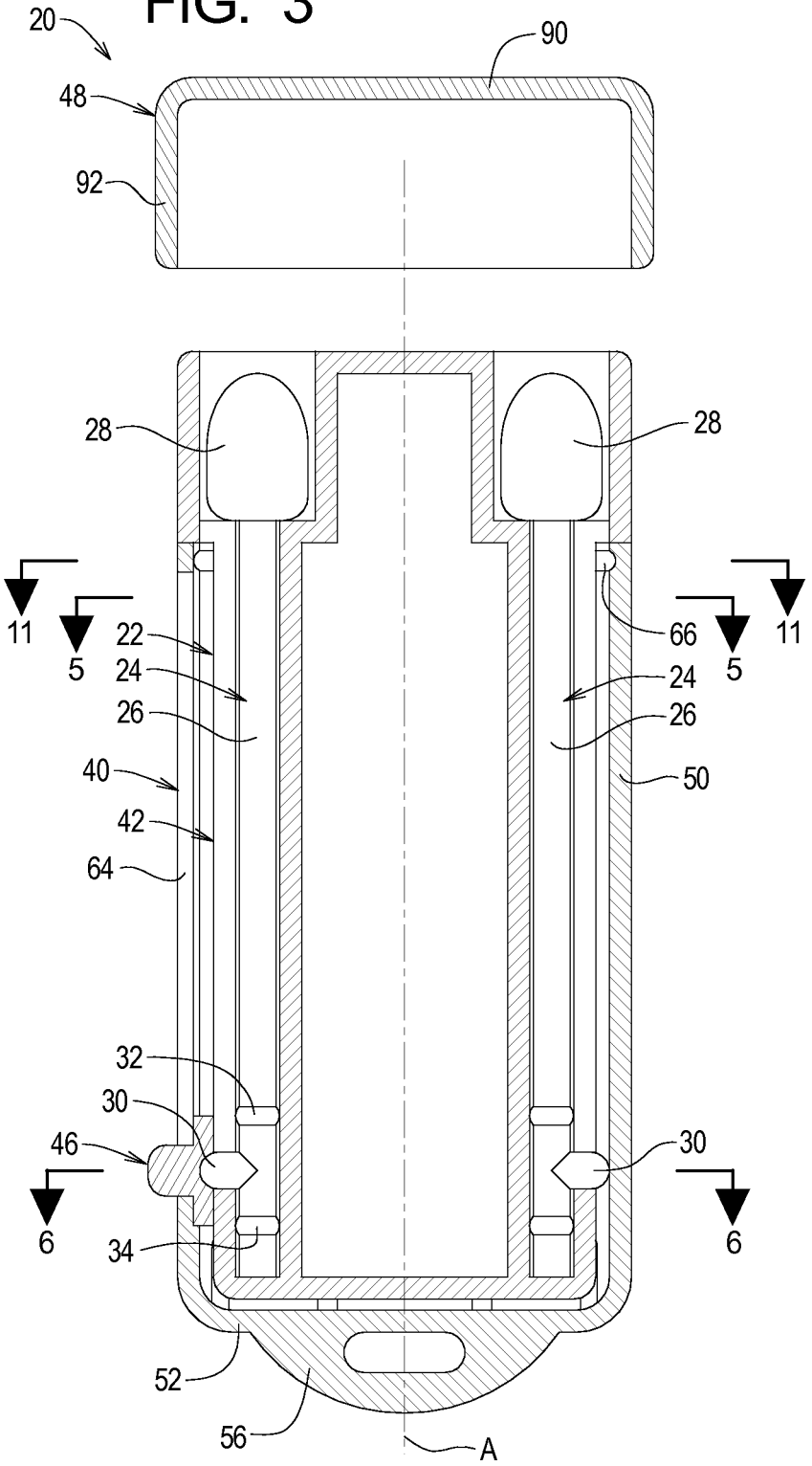
FIG. 3 is a section view similar to FIG. 2 illustrating a cap of the storage system removed from a container thereof.
Figure 4:
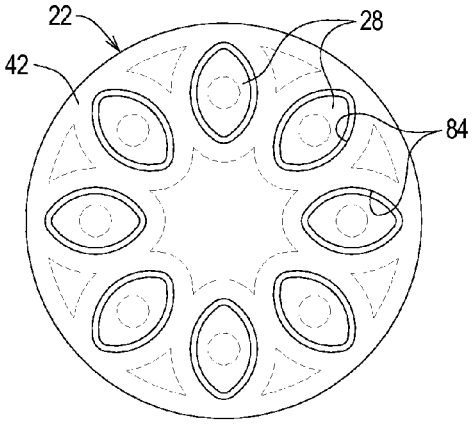
FIG. 4 is a top plan view of the first example storage system with the cap removed and depicting the container, a cartridge, and a plurality of items stored by the first example storage system.
Figure 5:
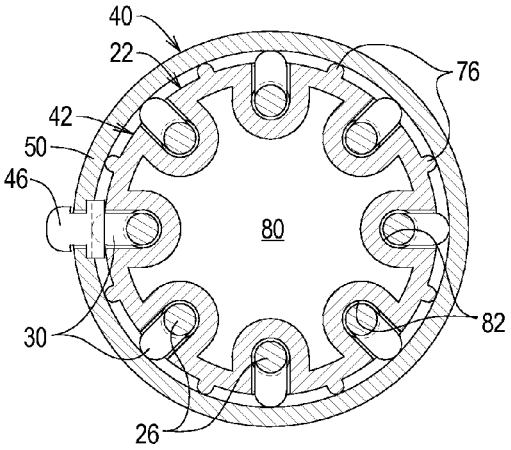
FIG. 5 is a section view taken along lines 5-5 in FIG. 3.

As perhaps best shown in FIG. 3, the example cap 48 comprises an end wall 90 and a side wall 92. The cap 48 may be made of clear material to facilitate the determination of which of the items 24 has been used or has been unused prior to removal of the cap 48. The example slide 46 comprises a base portion 94 from which extends a slide projection 96. A slide cavity 98 is formed in the example base portion 94.

If used, the item cover 44 is initially placed over the tips 28 of each of the example items 24. The items 24, either covered or uncovered, are placed in the cartridge 42 such that the shafts 26 are arranged in the shaft chambers 82 and the tips 28 are arranged in the tip chambers 84. With the items 24 supported by the cartridge 42, a cartridge assembly 22 is formed. As generally discussed above, a second item cover similar to the example item cover 44 may be arranged to cover the entire cartridge assembly 22 if the cartridge assembly 22 is sold as a replacement.

Figure 6:
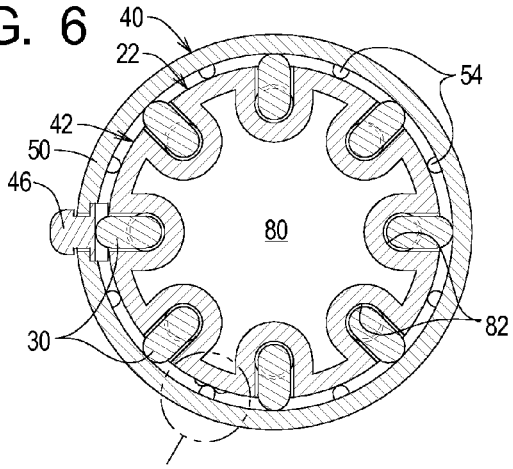
FIG. 6 is a section view taken along lines 6-6 in FIG. 3.
Figure 11:
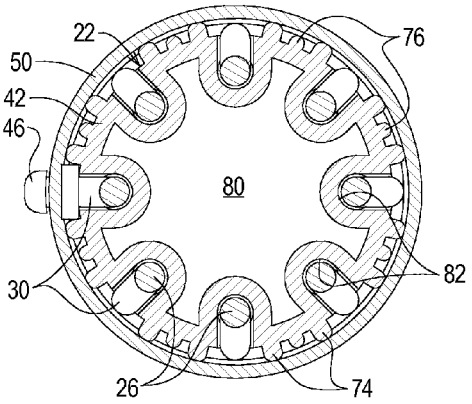
FIG. 11 is a section view taken along lines 11-11 in FIG. 3.

To form the example storage system 20, the slide 46 is next arranged such that the base portion 94 is within the container chamber 60 and the slide projection 46 extends at least partly through the guide slot 64. In particular, a lip or overhang **96*a* as shown in FIGS. 6 and 11 is snapped or forced through the guide slot 64 and engages the container 40 to prevent inadvertent removal of the slide 46 from the guide slot 64 but allows movement of the slide 46 along the guide slot 64. The cartridge assembly 22 is next removed from its cover, if necessary. The container 40 and cartridge assembly 22 are next substantially aligned along the container axis A and the cartridge assembly 22 displaced or inserted such that cartridge end wall 70 enters the container chamber 60. Further displacement or insertion of the cartridge assembly 22 causes the cartridge side wall 72 to engage the container locating ribs 54 and, at about the same time, the cartridge locating ribs 76 to engage the container side wall 50. The engagement of the ribs 54 with the cartridge side wall 72 and the ribs 76 with the container side wall 50 causes both the cartridge assembly 22 and the container 40** be aligned.

The slide 46 is at this point arranged at the end of the guide slot 64 adjacent to the end wall 52 of the container 40.

With the cartridge 42 inserted into the container 40, the alignment projections 74 engage and are received by the alignment grooves 66. The engagement of the alignment projection 74 with the alignment grooves 66 prevents inadvertent removal of the cartridge 42 from the container 40. However, deliberate application of manual force on the cartridge 42 allows the cartridge 42 to be removed from the container 40 when desired.

Figure 7:
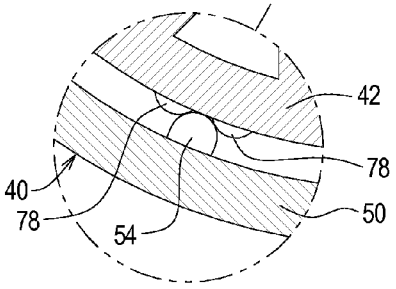
FIG. 7 is a detail of FIG. 6 illustrating a first relative angular orientation of the container with respect to the cartridge.
Figure 8:
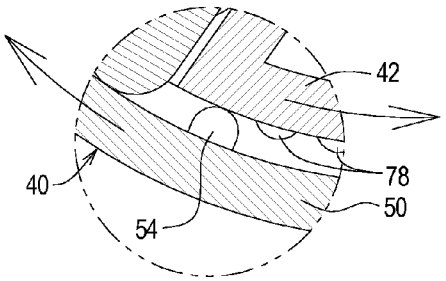
FIG. 8 is a detail similar to FIG. 7 illustrating movement of the container with respect to the cartridge out of the first angular orientation.

As is perhaps best shown in FIGS. 7 and 8, the cartridge 42 is then rotated relative to the container 40 such that the slide cavity 98 of the slide 46 receives the shaft projection 30 of one of the items 24. When the lock projections 78 engage one of the locating ribs 54, the slide cavity 98 receives the shaft projection 30. The stop projections 78 are thus angularly spaced relative to the access slots 86 and the locating ribs 54 are arranged around the interior of the container 40 such that each of the ribs 54 is associated with one of the slots 86. The engagement of the stop projections 78 with the locating ribs 54 positively locates the cartridge 42 relative to the container 40 at any one of a plurality of spaced angular locations. However, the shapes of the locating ribs 54 and the stop projections 78 are such that the cartridge 42 may easily be angularly rotated relative to the container 40 among the various spaced angular locations. In particular, the example locating ribs 54 and stop projections 78 are both rounded to allow the stop projection 78 to pass over the locating ribs 54 as shown in FIGS. 7 and 8.

At this point, the cap 48 is displaced such that the sidewall 92 thereof engages an outer surface of the side wall 72 of the cartridge 42 as perhaps best shown in FIG. 2.

When initially assembled, the example storage system 20 will thus contain eight of the items 24. Initially, at least a portion of the items 24 maybe covered by an item cover 44. The example container system 20 as shown in FIG. 2 is thus prepared for shipping, retail display, and storage prior to use.

Figure 12:
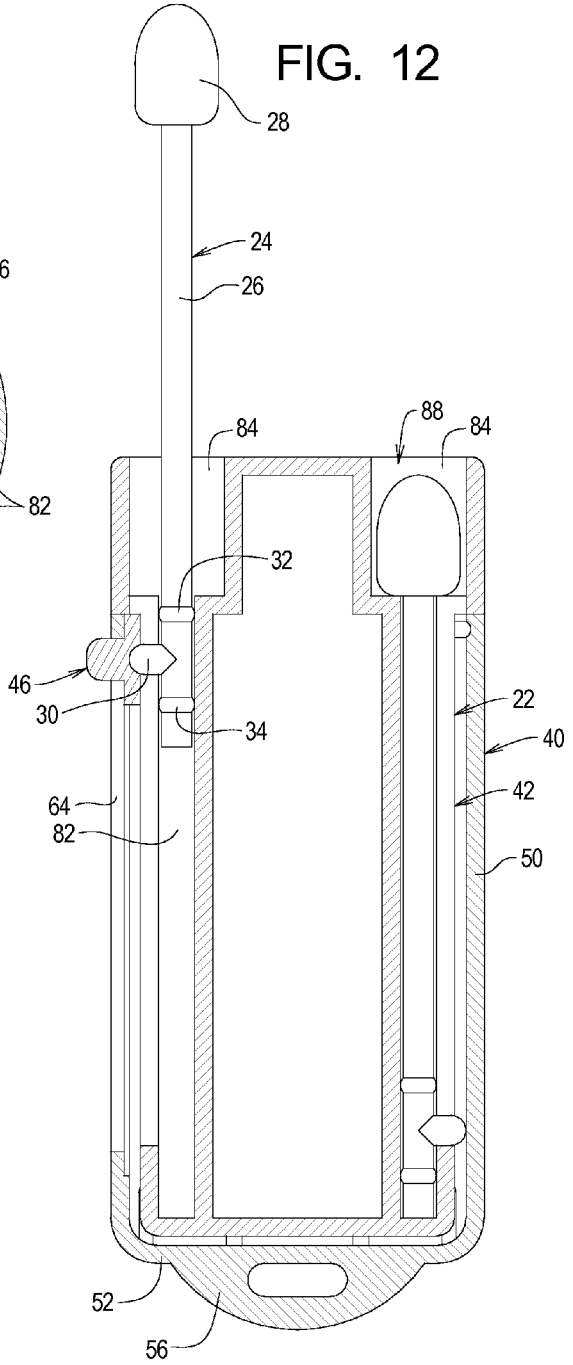
FIG. 12 is a section view depicting one of the items extended in a use position relative to the first example container system.

Immediately prior to use, the cap 48 is removed as perhaps best shown in FIG. 3. Then, the slide projection 96 is displaced with the users finger such that the slide 46 moves up along the guide slot 64. As the slide 46 move along the guide slot 64, the slide 46 engages the shaft protect projection 30 such that the item 24 is displaced as perhaps best shown in FIG. 12. When the slide 46 is moved to its end position as shown in FIG. 12, the item 24 is fully extended from the storage system 20. The shaft 26 of the item 24 should be of sufficient length that the tip 28 is easily accessible to the user for whatever purpose the item 24 is designed. If necessary, the item cover 44 is removed from the item 24 at this point. The item 24 may this be used according to its design when the items 24 are extended as shown in FIG. 12. Removal of the item cover 44 indicates that the particular item 24 has been used. In addition, the item cover 44 may be re-used to cover the tip 28 of the item 24 at the user's discretion and given the nature 24.

After the item 24 has been used, the slide 46 is moved in the opposite direction such that the item 24 is retracted as shown in FIG. 3.

At this point, the cartridge 42 maybe rotated relative to the container 40 such that the slide 46 is aligned with another one of the shaft projections 30 extending from another of the items 24. The storage system 20 is thus ready for use of another one of the items 24. In the meantime, the cap 48 may be replaced to protect the remaining items 24 in the storage system 20.

When one or more of the items 24 have been used, any used item 24 may be individually removed and replaced with an unused item 24. Alternatively, if all of the items 24 have been used, the entire cartridge assembly may be removed and replaced with a new cartridge assembly containing unused items 24.

The example storage system 20 comprises a tab opening 68 that may be used to attach the storage system 20 to a key ring or the like.

Referring now to FIGS. 14-17 of the drawing, depicted at 120 therein is a second example storage system constructed in accordance with, and embodying, the principles of the present invention. The example storage system 120 is adapted to store a cartridge assembly containing one or more items 122. The nature of the items 122 is not per se part of the present invention, and the items 122 may take many different specific forms and still be stored effectively by the example storage system 120.

The example item 122 comprises a shaft 124 and first and second tips 126 and 128. The tips 126 and 128 are typically the working or carrying portion of the item 122. The shaft 124 is typically provided primarily for the purpose of manipulating the tips 126 and 128 but may provided with additional functions such as fluid storage or the like. The tips 126 and 128 may be, as examples, a cotton tip, a makeup applicator, toothbrush bristles, a sampling swab, a needle, and/or a biometric sensor. The tips 126 and 128 thus may be a passive mechanical structure (e.g., cotton tip, makeup applicator, toothbrush bristles, sampling swab), or may be a mechanical system (e.g., needle) or an electromechanical system capable of performing an active function (e.g., biometric sensor). In any event, the example item or items 122 are not per se part of the present invention.

The example item 122 is modified to work as part of the second example storage system 120. In particular, a first shaft projection 130 and first, second, third, and fourth guide rings 132, 134, 136, and 138 extend from the shaft 124 of the item 122. The purpose of the shaft projection 130 and the guide rings 132, 134, 136, and 138 will be apparent from the following discussion.

Figure 13:
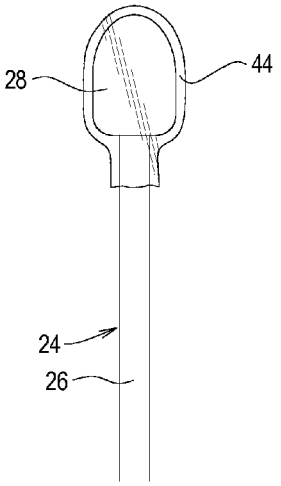
FIG. 13 depicts an optional item cover that may be used to inhibit contamination of the item when stored by the first example storage system.
Figure 14:
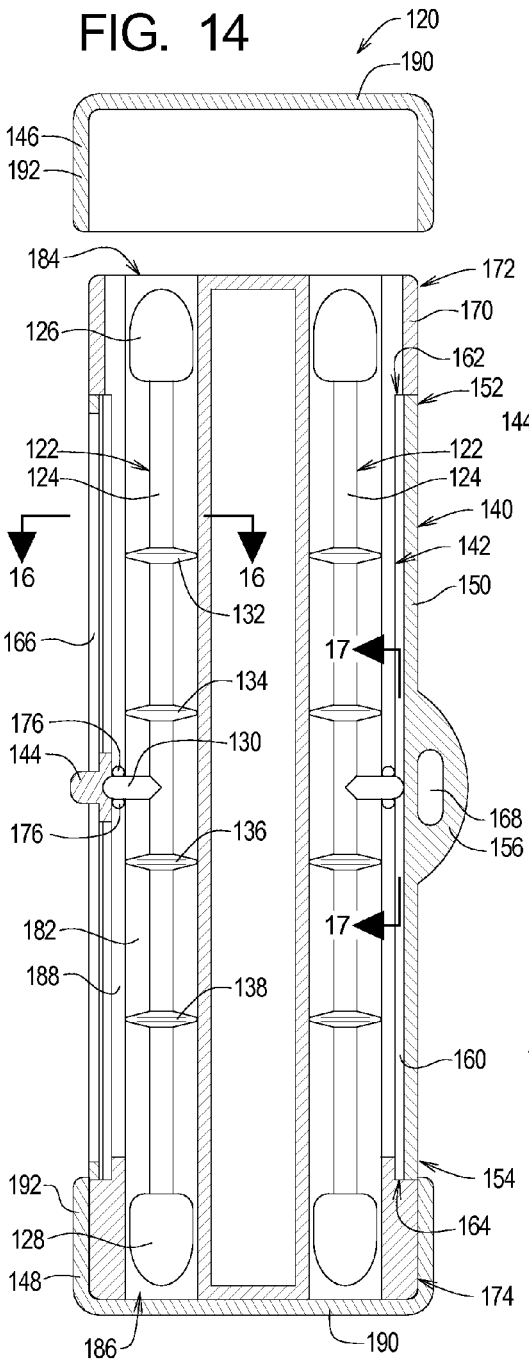
FIG. 14 is a section view of a second example container system of the present invention.
Figure 15:
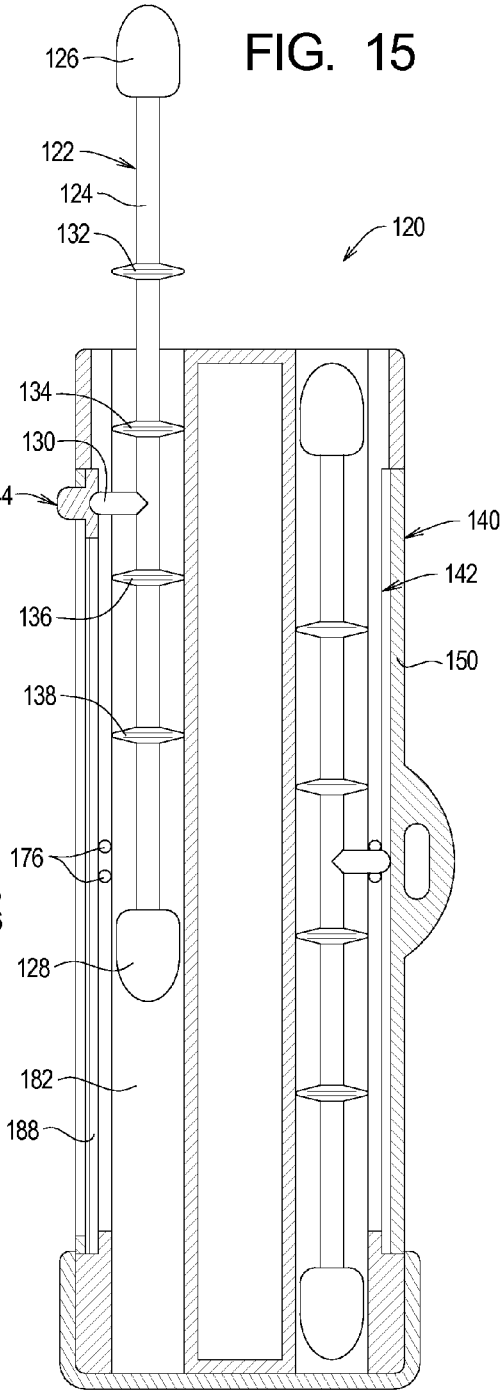
FIG. 15 is a section view similar to FIG. 14 with a stored item in an extended use configuration relative to the second example storage system.

As perhaps best shown in FIGS. 14 and 15, the example storage system 120 comprises a container 140 defining a container axis A, a cartridge 142, a slide 144, and first and second caps 146 and 148. The item cover 44 as shown in FIG. 13 is optional depending on the nature of the item 122 and will be discussed in further detail below. In addition, the cartridge 142 may be replaceable as will be further described below. In this case, prior to use a second size and shape of item cover (not shown) may be used to cover the entire cartridge 142, with any included items 122, such as during shipping, retail display, and storage.

FIGS. 14 and 15 further show that the example container 140 defines a side wall 150 having open first and second ends 152 and 154. A tab 156 extends from the side wall 150 of the example container 140. The example container 140 further defines a container chamber 160. Access to the container chamber 160 is through first and second container openings 162 and 164 and a guide slot 166 extending through the side wall 150 from adjacent to the first end 152 to adjacent to the second opening 154. A tab opening 168 is formed in the example tab 156.

FIGS. 14 and 15 of the drawing further illustrate that the example cartridge 142 defines a side wall 170 having first and second ends 172 and 174. A pair of stop projections 176 extend from the inner surface of the side wall 170. Additionally, the example cartridge 142 further defines a cartridge chamber 180 and one or more item chambers 182. Each item chamber 182 defines first and second item openings 184 and 186. An access slot 188 is formed in the cartridge for each item chamber 182 and extends from adjacent the first and second item openings 184 and 186. The example cartridge chamber 180 is depicted as being empty in the example cartridge 142 but may be filled with fluids, electronics, energy storage devices (batteries), or the like depending on the details and/or intended use of a particular item 122 and cartridge 142.

Figure 17:
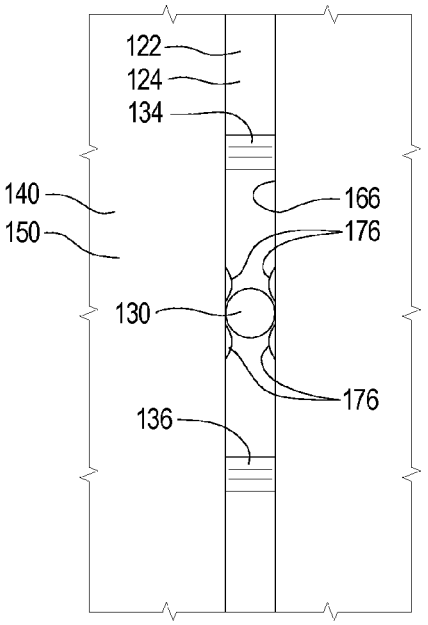
FIG. 17 is a side elevation detail view taken along lines 17-17 in FIG. 14.

As perhaps best shown in FIG. 17, two pairs of the example stop projections 176 extend into the access slots 188. When the items 122 are in a central position relative to the cartridge 142, the stop projections 176 engage the shaft projections 130 to prevent inadvertent movement of the items 122 from the central position as shown in FIG. 14. However, the shaft projections 130 and the stop projections 176 are sized, dimensioned, and shaped to allow the slide 144 to move the items 122 out of the central position by deliberate application of manual force as will be described in further detail below.

As perhaps best shown in FIG. 14, the example caps 146 and 148 are identical and each comprises an end wall 190 and a side wall 192. The caps 146 and 148 may be made of clear material to facilitate the determination of which of the items 124 has been used or has been unused prior to removal of the cap 48. The example slide 144 comprises a base portion 194 from which extends a slide projection 196. A slide cavity 198 is formed in the example base portion 194.

If used, an item cover is initially placed over the tips 126 and 128 of each of the example items 122. The items 122, either covered or uncovered, are placed in the cartridge 142 such that the items 122 are arranged in the item chambers 182. Initially, the items 122 are all arranged in the central position depicted in FIG. 14 with the shaft projections 130 held within the stop projections 176 as generally described above. The guide rings 132, 134, 136, and 138 engage the walls defining the item chambers 182 to align the shafts 124 of the items 122 within the chambers 182. And with the items 122 so supported within the chambers 182, the shaft projections 130 engage the slide 144 to allow the slide 144 to displace the items 122 within the chambers 182 as will be described in further detail below.

With the items 122 supported by the cartridge 142, a cartridge assembly is formed. As generally discussed above, a second item cover similar to the example item cover 44 shown in FIG. 13 may be arranged to cover the entire cartridge assembly if the cartridge assembly is sold as a replacement.

To form the example storage system 120, the slide 144 is next arranged such that the base portion 194 is within the container chamber 160 and the shaft projection 130 extends at least partly through the guide slot 166. The cartridge assembly is next removed from its cover, if necessary. The container 140 and cartridge assembly are next substantially aligned along the container axis A and the cartridge 142 displaced such that cartridge enters the container chamber 160. To facilitate insertion of the cartridge 142 into the container 140, the cartridge 142 may configured as a two-piece construction that is disassembled during insertion and removal of the cartridge 142 but assembled during normal use of the storage system 120. For example, instead of being made of a solid construction as shown in FIG. 14, the second end 174 may comprise a retaining ring (not shown) that would be removed to reduce the diameter of the second end 174 during insertion and removal of the cartridge 142 but would be attached (e.g., threads, friction fit, snap fit, detent lock) to prevent inadvertent removal of the cartridge 142 from the container 140 during normal use of the container storage system 120. Other structures and methods for allowing insertion and removal of the cartridge 142 but preventing inadvertent removal during normal use may be employed.

Figure 16:
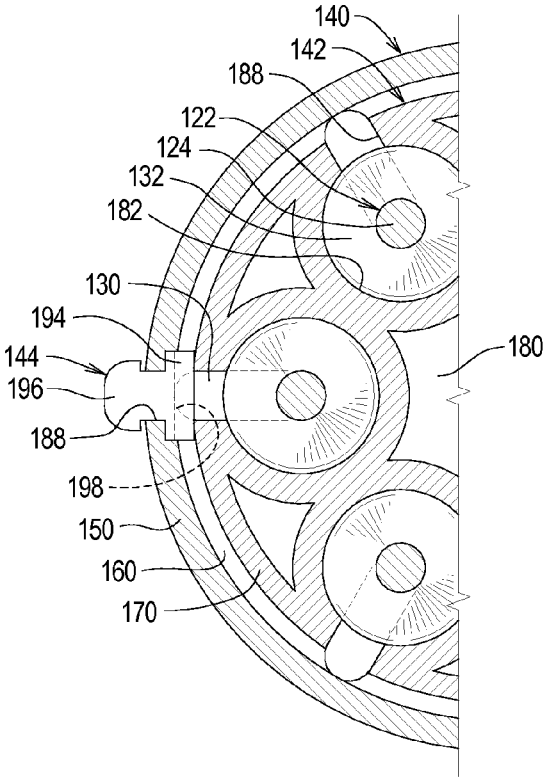
FIG. 16 is a partial section view taken along lines 16-16 in FIG. 14.

Further displacement of the cartridge 142 after the cartridge initially enters the cartridge chamber 160 causes the cartridge side wall 170 frictionally to engage the container side wall 150, thereby securing the cartridge 142 within the container chamber 160. However, deliberate application of manual force on the cartridge 142 allows the cartridge 142 to be removed from the container 140 when desired. The cartridge 142 is then rotated relative to the container 140 such that the slide cavity 198 of the slide 144 receives the shaft projection 130 of one of the items 122 as shown in FIG. 16.

At this point, the caps 146 and 148 are displaced such that the sidewalls 192 thereof engages an outer surface of the side wall 170 of the cartridge 142 as perhaps best shown in FIGS. 14 and 15.

When initially assembled, the example storage system 120 will thus contain eight of the items 122 each having two tips for 16 possible uses. Initially, at least a portion of the items 122 maybe covered by an item cover; typically, each end of the items 122 will be covered by a separate cover. The example container system 120 as shown in FIG. 14 is thus prepared for shipping, retail display, and storage prior to use.

Immediately prior to use, one of the caps 146 and 148 is removed as perhaps best shown in FIGS. 14 and 15. Then, the slide projection 196 is displaced with the user's finger such that the slide 144 moves up along the guide slot 166. As the slide 144 move along the guide slot 166, the slide 144 engages the shaft projection 130 such that the item 122 is displaced as perhaps best shown in FIG. 15. When the slide 144 is moved to its end position as shown in FIG. 15, the first end of the item 122 is fully extended from the storage system 120. The shaft 124 of the item 122 should be of sufficient length that the first tip 126 is easily accessible to the user for whatever purpose the item 122 is designed. If necessary, the item cover 44 is removed from the item 122 at this point. The item 122 may thus be used according to its design when the items 122 are extended as shown in FIG. 15. The opposite cap is then removed and the item 122 moved in the opposite direction to allow the other end of the item 122 to be used in this second example storage system 120.

At this point, the cartridge 142 maybe rotated relative to the container 140 such that the slide 144 is aligned with another one of the shaft projections 130 extending from another of the items 122. The storage system 120 is thus ready for use of either or both ends of another one of the items 122. The caps 146 and 148 are typically replaced between uses to protect the remaining items 122 in the storage system 120.

The example storage system 120 comprises a tab opening 168 that may be used to attach the storage system 120 to a key ring or the like.

What is claimed is:

1. A container system for an item comprising a shaft and at least one working end, the container system comprising:

a container defining a container chamber and a guide slot;

a cartridge defining a plurality of item chambers and an access slot associated with each item chamber;

a slide adapted to extend through the guide slot;

a shaft projection extending from the shaft of the item, where the shaft projection extends through the access slot and engages the slide such that movement of the slide causes movement of the item; and at least one locating rib formed on the container; and at least one stop projection formed on the cartridge; wherein the at least one locating rib engages the at least one stop projection to allow the cartridge to be positively located at any one of a plurality of angularly spaced locations relative to the container.

2. A container system as recited in claim 1, further comprising:

a plurality of locating ribs formed on the container; and at least one stop projection formed on the cartridge; wherein the locating ribs engage the at least one of the stop projections to positively locate the cartridge at a plurality of angularly spaced locations relative to the container.

3. A container system as recited in claim 1, further comprising:

at least one locating rib formed on the container; and a pair of stop projections formed on the cartridge; wherein the at least one locating rib engages the pair of stop projections to allow the cartridge to be positively located at any one of a plurality of angularly spaced locations relative to the container.

4. A container system as recited in claim 1, further comprising:

a plurality of locating ribs formed on the container; and a pair of stop projections formed on the cartridge; wherein the locating ribs engage the pair of stop projections to positively locate the cartridge at a plurality of angularly spaced locations relative to the container.

5. A container system as recited in claim 1, further comprising a plurality of alignment projections extending from the cartridge, where the plurality of alignment projections engage the container to maintain the cartridge in a desired relationship with the container.

6. A container system as recited in claim 1, further comprising at least one guide ring extending from the shaft of the item, where the at least one guide ring engages the cartridge to maintain the item in a desired relationship with the cartridge.

7. A container system as recited in claim 1, in which:

the slide defines a recess; and the shaft projection engages the recess such that displacement of the slide along the guide slot causes displacement of the item along the item chamber.

8. A container system as recited in claim 1, in which at least one stop projection extends from the container, where the at least one stop projection engages the item to maintain the item in a storage position within the cartridge.

9. A container system for an item comprising a shaft and first and second working ends, the container system comprising:

a container defining a container chamber and a guide slot;

a cartridge defining a plurality of item chambers and an access slot associated with each item chamber;

a slide adapted to extend through the guide slot;

a shaft projection extending from the shaft of the item, where the shaft projection extends through the access slot and engages the slide such that movement of the slide causes movement of the item;

at least one locating rib formed on the container; and at least one stop projection formed on the cartridge; wherein the at least one locating rib engages the at least one stop projection to allow the cartridge to be positively located at any one of a plurality of angularly spaced locations relative to the container.

10. A container system as recited in claim 9, further comprising:

a plurality of locating ribs formed on the container; and at least one stop projection formed on the cartridge; wherein the locating ribs engage the at least one of the stop projections to positively locate the cartridge at a plurality of angularly spaced locations relative to the container.

11. A container system as recited in claim 9, further comprising:

at least one locating rib formed on the container; and a pair of stop projections formed on the cartridge; wherein the at least one locating rib engages the pair of stop projections to allow the cartridge to be positively located at any one of a plurality of angularly spaced locations relative to the container.

12. A container system as recited in claim 9, further comprising:

a plurality of locating ribs formed on the container; and a pair of stop projections formed on the cartridge; wherein the locating ribs engage the pair of stop projections to positively locate the cartridge at a plurality of angularly spaced locations relative to the container.

13. A container system as recited in claim 9, further comprising a plurality of alignment projections extending from the cartridge, where the plurality of alignment projections engage the container to maintain the cartridge in a desired relationship with the container.

14. A container system as recited in claim 9, further comprising at least one guide ring extending from the shaft of the item, where the at least one guide ring engages the cartridge to maintain the item in a desired relationship with the cartridge.

15. A container system as recited in claim 9, in which:

the slide defines a recess; and the shaft projection engages the recess such that displacement of the slide along the guide slot causes displacement of the item along the item chamber.

16. A container system as recited in claim 9, in which at least one stop projection extends from the container, where the at least one stop projection engages the item to maintain the item in a storage position within the cartridge.

17. A container system as recited in claim 9, in which a pair of stop projections extend from the container, where the pair of stop projections engage the shaft projection to maintain the item in a storage position relative to the cartridge.

18. A container system for an item comprising a shaft and at least one working end, the container system comprising:

a container defining a container chamber and a guide slot;

a cartridge defining a plurality of item chambers and an access slot associated with each item chamber;

a slide adapted to extend through the guide slot, where the slide defines a recess;

a shaft projection extending from the shaft of the item, where the shaft projection extends through the access slot and engages the slide such that movement of the slide causes movement of the item; wherein the shaft projection engages the recess such that displacement of the slide along the guide slot causes displacement of the item along the item chamber.

19. A container system for an item comprising a shaft and first and second working ends, the container system comprising:

a container defining a container chamber and a guide slot;

a cartridge defining a plurality of item chambers and an access slot associated with each item chamber;

a slide adapted to extend through the guide slot, where the slide defines a recess;

a shaft projection extending from the shaft of the item, where the shaft projection extends through the access slot and engages the slide such that movement of the slide causes movement of the item; wherein the shaft projection engages the recess such that displacement of the slide along the guide slot causes displacement of the item along the item chamber.

* * * * *